United States Patent [19]

Sirota

[11] Patent Number: 4,601,668

[45] Date of Patent: Jul. 22, 1986

[54] DOLL HEART MONITORING TOY

[76] Inventor: Vladimir Sirota, 130 W. 67 St., New York, N.Y. 10023

[21] Appl. No.: 734,173

[22] Filed: May 15, 1985

[51] Int. Cl.[4] ..... A63H 33/26

[52] U.S. Cl. ..... 446/130; 446/295; 446/472; 446/485

[58] Field of Search ..... 446/130, 295, 297, 303, 446/472, 485; 434/262, 265, 266, 267, 275; 128/1 C

[56] References Cited

U.S. PATENT DOCUMENTS

| | | | |
|---|---|---|---|
| 3,024,568 | 3/1962 | Barnett | 446/472 |
| 3,232,004 | 2/1966 | Felsher | 446/130 |
| 3,564,729 | 2/1971 | Ackerman | 434/266 |
| 3,994,282 | 11/1976 | Moulet | 434/266 X |
| 4,155,196 | 5/1979 | Bollinger et al. | 446/130 |
| 4,307,539 | 12/1981 | Klein | 446/472 |

*Primary Examiner*—Mickey Yu

*Attorney, Agent, or Firm*—Ilya Zborovsky

[57] ABSTRACT

A doll heart monitoring toy includes a doll element, a stethoscope element, an electronic device operative for producing signals imitating at least one characteristic of heart activity and arranged in one of the elements, and a magnetic member arranged to activate the electronic device upon bringing the magnetic member in proximity to the electronic device, or in other words upon bringing the stethoscope close to the heart region of the doll. The electronic device including a sensor and signal generators for activating a sound device and a light device in response to the sensor sensing pulse beats of a user.

18 Claims, 8 Drawing Figures

FIG. 4
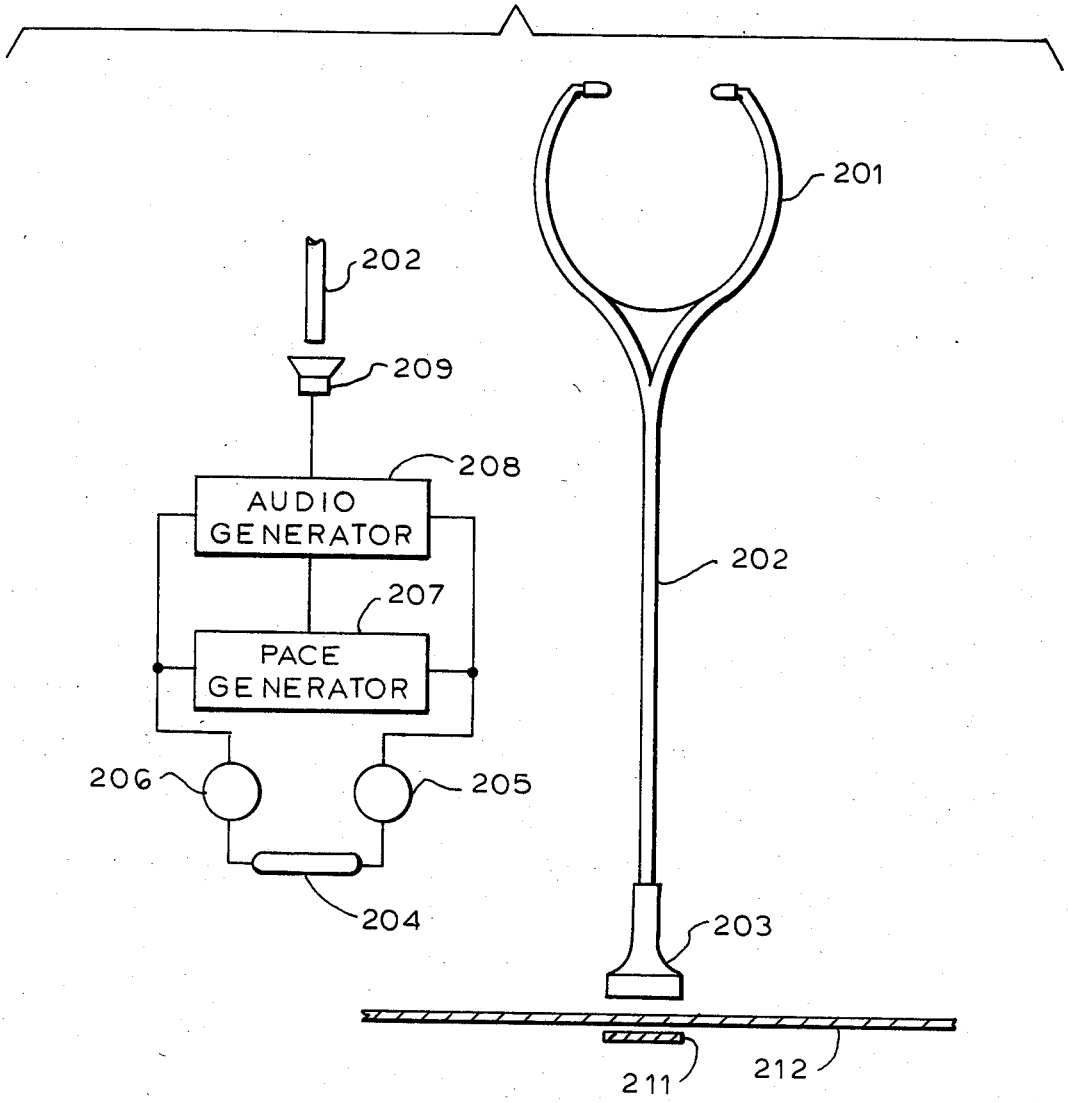
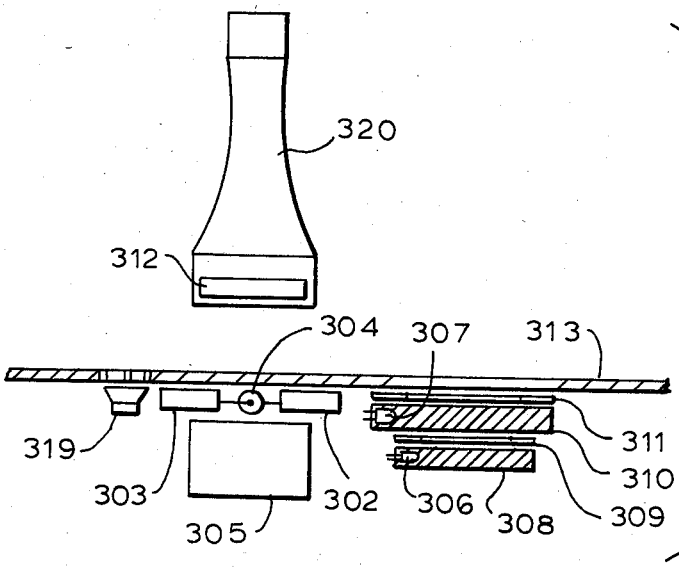
FIG. 6

DOLL HEART MONITORING TOY

BACKGROUND OF THE INVENTION

The present invention relates to a doll heart monitoring toy.

Doll heart monitoring toys are known in the art. A known toy of this type includes a doll and a stethoscope. A child immitates doll heart monitoring by introducing the stethoscope into his or her ears and applying the opposite end to the dolls chest in the region of its imaginary heart. Though children readily play with this toy, its attractiveness is of a very limited value, since the children do not hear in the process of heart monitoring the sounds of heart or pulse beat of the doll. Also, there is no video display of the doll's heart activity.

SUMMARY OF THE INVENTION

Accordingly it is an object of the present invention to provide a doll heart monitoring toy which has a greater attractiveness for children than the existing toys.

In keeping with this object and with others which will become apparent hereinafter, one feature of the present invention resides, briefly stated, in a doll heart monitoring toy which has a doll, a stethoscope, electronic means producing at least one characteristic which immitates heart activity, and a magnetic member operative for turning on the electronic means, wherein the electronic means is located in one of the doll and stethoscope while the magnetic member is located in the other of the doll and stethoscope, so that when the stethoscope is brought into contact with the doll the electronic means produces the characteristic of the heart activity.

In accordance with the invention, audio and/or video signals can be produced to immitate the heart activity or to be in correspondence with the pulse beats of a user.

The novel features of the invention are set forth in particular in the appended claims. The invention itself, however, will be best understood from the following description of preferred embodiments, which is accompanied by the following drawings.

BRIEF DESCRIPTION OF THE DRAWINGS

FIG. 4 is a view showing the toy in accordance with another embodiment of the invention;

FIG. 6 shows the toy substantially corresponding to FIG. 5, but in correspondence with a different embodiment.

DESCRIPTION OF PREFERRED EMBODIMENTS

Figure 1:
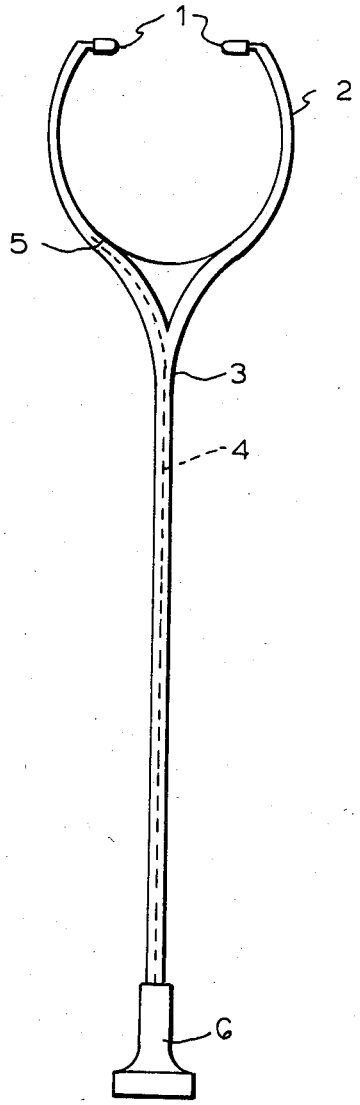
FIG. 1 is a view showing a stethoscope of a toy in accordance with the present invention.

FIG. 1 shows a stethoscope of a toy in accordance with the present invention. It has earphones 2, a plastic tube 3 and an electronic device 6. The earphones are used here both to function as conventional earphones and also as one pole electrode of a hear pulse transducer as will be explained hereinbelow. A signal lead 4 is connected with a metal tube of the earphones in a point 5 and extends through the rubber tube 3 to the electronic device 6. The earphones are provided with metal tips 1 for better electrical contact with the child's ears. The tube 3 serves as a sonic conductor between the earphones and a sonic transducer 16 which is a part of the electronic device 6. It is also used signal lead 4.

Figure 2:
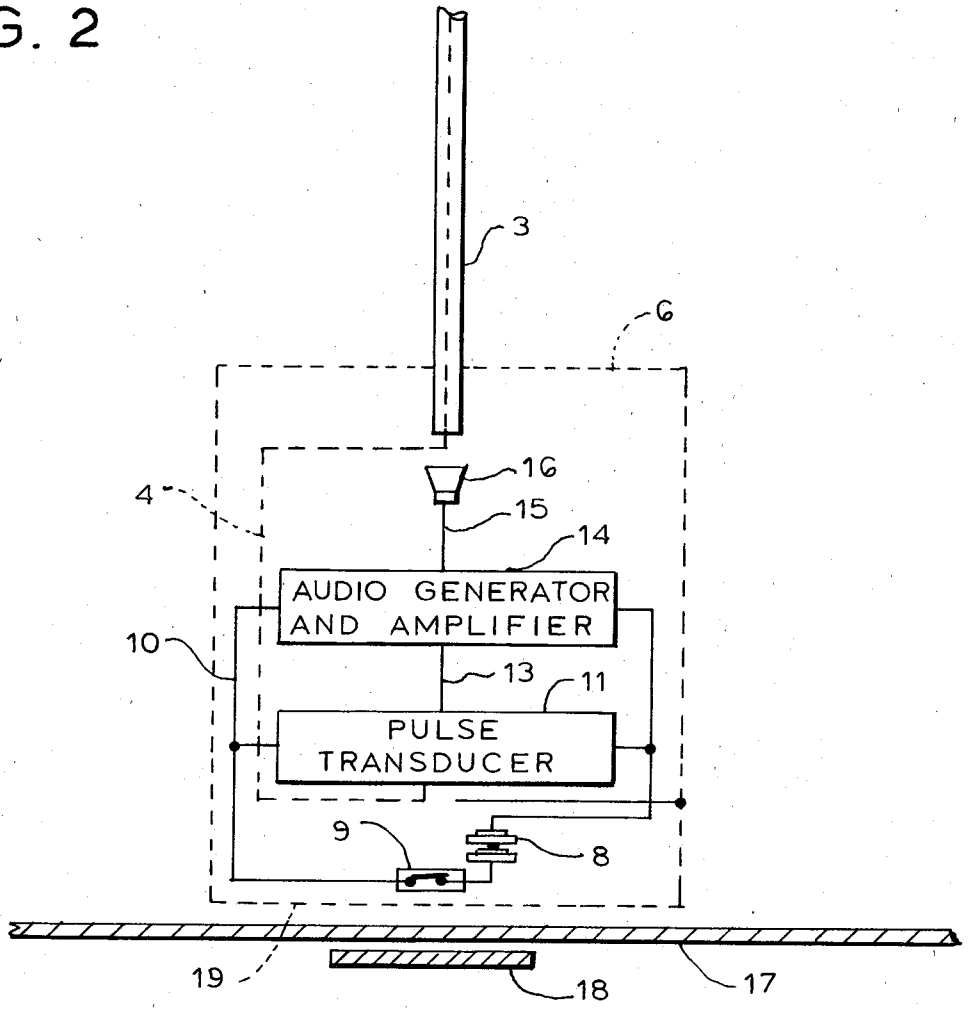
FIG. 2 is a view showing electronic means and a magnetic member for turning it on, associated with the doll and the stethoscope of the toy.

The electronic device 6 is arranged in a round metallic cover as shown in FIG. 2. The device includes a battery 8 of a watch type, connected through a reed switch 9 and by leads 10 and 11 to a heart pulse transducer 12 and an audio generator and amplifier 14. The sonic transducer 16 is connected to the audio generator and amplifier by a lead 15. A small magnetic member 18 is installed under the surface of a doll 17 in the region of an imaginary heart. When the electronic device 6 is brought by its base 19 to or onto this region of the doll, the magnetic member 18 turns on the reed switch 9 and the device begins to work.

Figure 3:
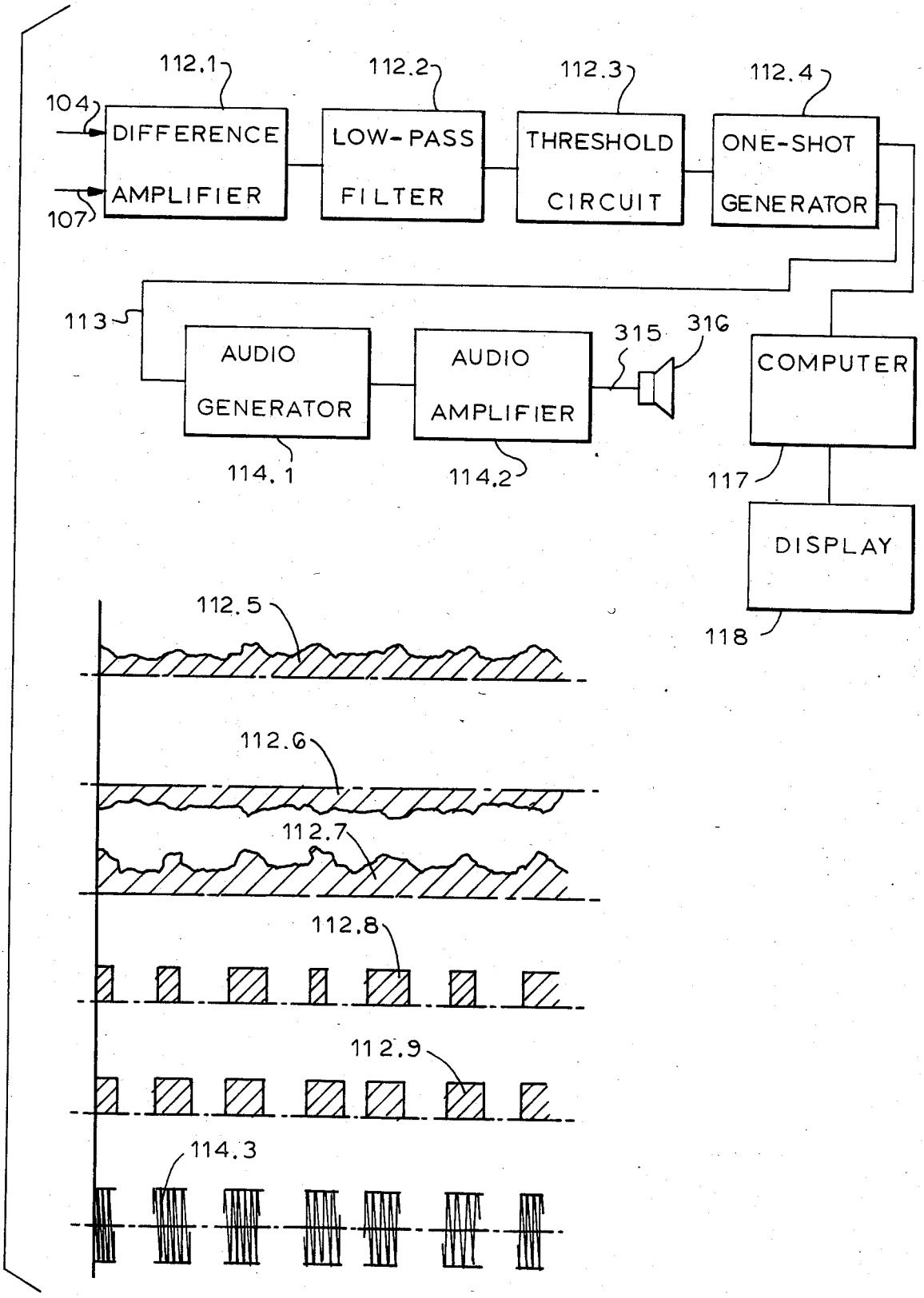
FIG. 3 is a view showing the details of the electronic device of the electronic means of FIG. 2.

FIG. 3 shows some details of the electronic device 6 and its waveforms. The transducer 12 includes a difference amplifier 112.1, a low-pass filter 112.2, a threshold circuit 112.3, a one-shot pulse generator 112.4 and waveforms 112.5, 112.6, 112.7, 112.8, 112.9. The audio generator and amplifier 14 includes an audio generator 114.1, an amplifier 114.2 and a waveform 114.3. The heart pulse transducer 12 is connected with the audio generator and amplifier 14 by a lead 113. The input lead 4 (104) extends from the earphones as a first bioelectrical electrode, and the lead 107 is connected to the metal cover of the electronic device 6 as a second electrode. They transfer bioelectrical signals 112.5 and 112.6 to the difference amplifier 112.1. These signals are amplified and go through the low pass filter 112.2. Signal 112.7 is applied to the threshold circuit which generates square pulses 112.8. A square pulse train is fed to the one shot pulse generator 112.4 to produce a constant amplitude and constant width pulse train 112.9. The pulse train 112.9 sets the audio generator 114.1 to produce an audio signal 114.3. The audio signal 114.3 is amplified by the audio amplifier 114.2 and feeds the sonic transducer 116 via the lead 115 to convert the electrical signals to sound. The sonic signals of approximately 200 cycles per second are applied through the rubber tube 3 to the earphones. A child actually hears his or her own heart beat, when he monitors his doll's pulse.

Figure 7:
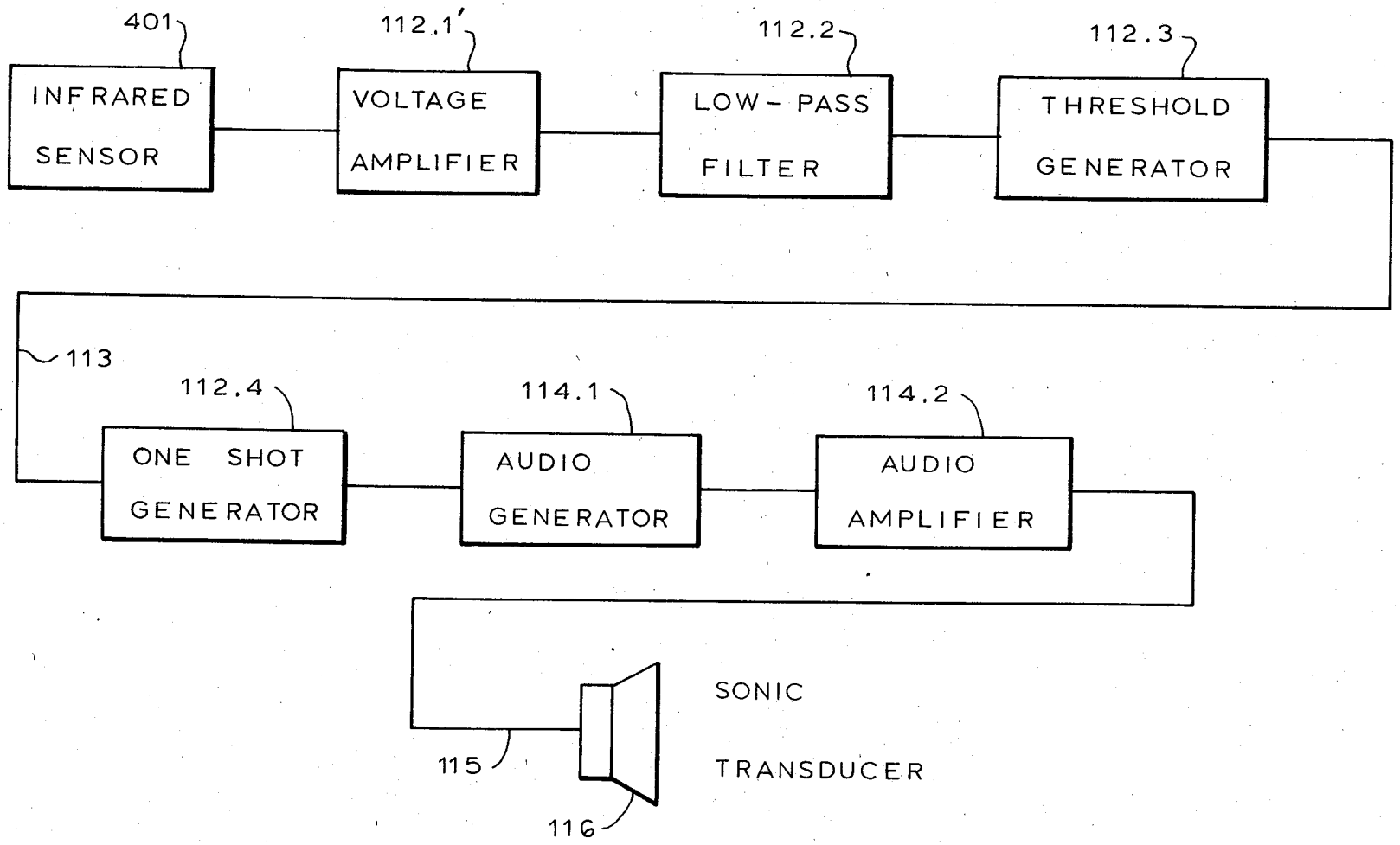

Instead of biopotential electrodes as desribed above, an infrared transmission transducer on an ear lobe or a finger can be used, as shown in FIG. 7. In this case a difference amplifier 112.1 is replaced by a conventional voltage amplifier 112.1', and the waveform 112.5 will not be used.

The toy of a somewhat simpler type is shown in FIG. 4. Earphones of medical type 201 are used with a rubber tube 202 and an electronic device 203. A small magnetic member 211 is installed under the surface of a doll 212, as described before, and operates in the same manner. The magnetic member turns on the reed switch and the electronic device which includes batteries 205,206, a pace generator 207, an audio generator 208 and a sonic transducer 209. A human pulse is immitated here by the pace generator 207 which controls the audio generator 208. It produces the audio signal transduced by the sonic transducer 209. This sound passes through the tube 202 to the earphones. When the device is removed from the region of the magnetic member, its operation is interrupted.

Figure 5:
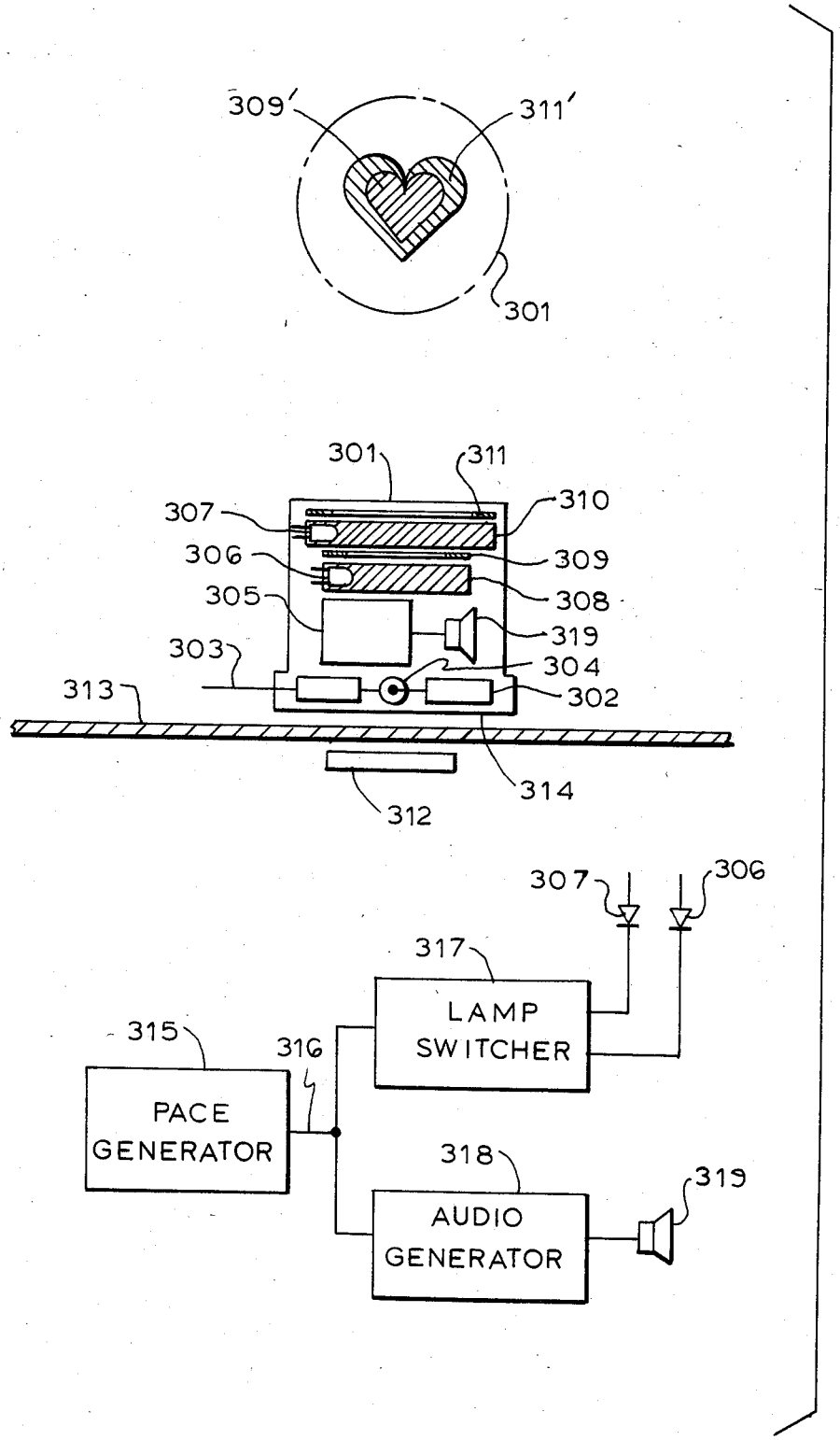
FIG. 5 is a view showing the toy in accordance with a further embodiment of the invention, for producing video signals.

FIG. 5 shows a toy in which heart activity of the doll's heart is visually illustrated. The toy has a plastic or metallic cover 301, batteries 302, 303 of watch type, a reed switch 304, an electronic device 305, light emitting diodes 306,307, light conductors 308, 310, and masks 309, 311. As in the case of the above described stethoscope, a small magnetic member 312 is installed under the surface of the doll 313. When the device is applied by its base on the region of the doll heart wherein the magnetic member is arranged, the magnetic member 312 turns the reed switch 304 and the device begins to operate. A pace generator 315 which is a part of the electronic device 305 produces rhythmic pulses of a square form, at about 70 cycles per minute. These pulses control, via a lead 316 both a lamp switcher 317 and an audio generator 318. The lamp switcher turns on either of the light emitting diodes 306 or 307, and turns them off. The diodes are lit alternatively. The diodes are set in colored plastic glass components. When either diode 306 or diode 307 is on, it illuminates the whole area of the respective light conductor 308 or 310. The masks are installed in front of both light conductors 308 and 310 and formed as a smaller heart and a bigger heart respectively. When either diode 306 or 307 is on, the smaller heart 309' or the bigger heart 311' will be lit. On the other hand, the smaller heart can be always on, while the greater heart can be alternatively on and off. The pulses from the pace generator control the audio generator 318 as well. This generator produces an audio signal, about 800 cycles per second and is connected directly to a sonic transducer 319. The operation of the audio generator 318 is synchronized with lighting of the hearts, for example of only the bigger heart, and is on when the latter is on.

It is to be understood that the operation of the device shown in FIG. 5 can be performed in accordance with pulse beats of a child, by connecting it to a child pulse sensors as described with reference to FIGS. 1-3 and 7. In this case the audio generator 318 and the lighting of the hearts will be performed in accordance with the pulse beats of the child.

As shown in the right upper corner of FIG. 3 the toy can additionally include a computer 117 connected with the one-shot generator, and a display 118 connected with the computer. In this construction the pulse beat can be displayed, for example in a digital form, on the display. In this case the toy can simultaneously serve as a conventional human pulse monitoring device, thus performing not only the playing function, but also the function of a medical device.

The range of use of the toy considerably widens, and the child is involved in serious relations with adults, other children by playing the role of a physician. In addition the child can take a pulse of his or her pets.

FIG. 6 shows a toy which corresponds to the toy of FIG. 5 with the only difference that the magnetic member is installed in a small handle 320, whereas the other parts of the electronic device are installed in the doll. The parts are identified with the same reference numerals, and the toy operates in the same manner as the toy shown in FIG. 5.

Figure 8:
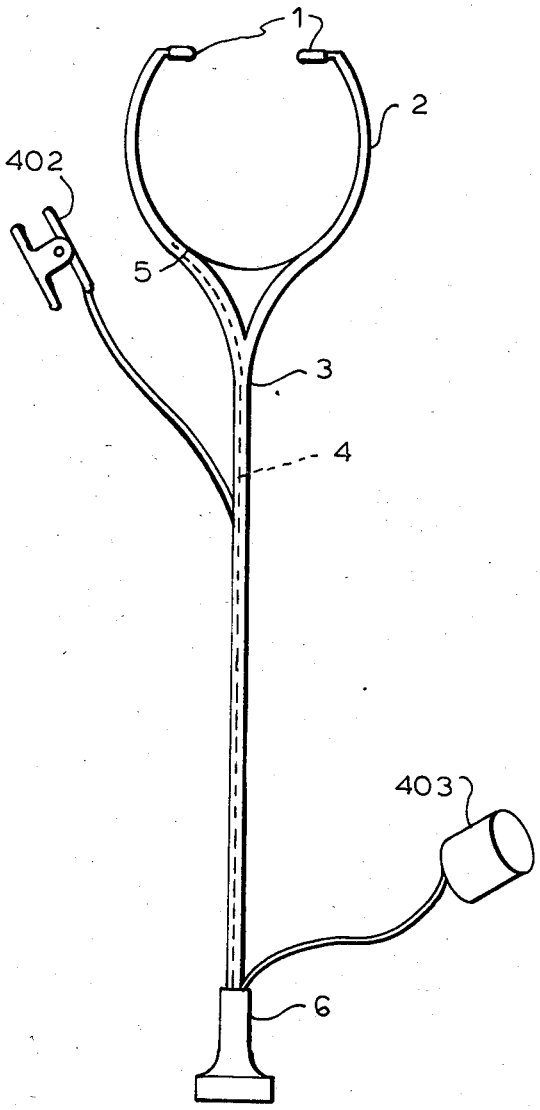
FIGS. 7 and 8 illustrate still further embodiments of the inventive toy.

Finally, FIG. 7 shows the toy in which an infrared sensor 401 is used, attachable to an ear lobe or settable on a finger. FIG. 7 shows a block-diagram of this embodiment. FIG. 8 shows the stethoscope of the toy with the respective sensors which can be used alternatively. A sensor 402 is attachable to an ear lobe, while a sensor 403 is settable on a finger.

Instead of or in addition to the embodiments described above in which the magnetic member is located in the region of the doll heart and the video signals are represented by the contracting and expanding heart, there can be (instead or in addition) a magnetic member located in the region of the doll's wrist and the video signals can be represented by a flashing point-like light.

The magnetic member can be arranged on the doll's body, inside the doll's body, and also on the clothes of the doll, in the region of the doll's heart and/or wrist. The magnetic member on the body and on the clothes can be formed heart-shaped.

In the case of the wrist pulse monitoring, the magnetic member can be located in the stethoscope (or handle), while the electronic means is located in the doll.

The invention is not limited to the details shown, since various modifications and structural changes are possible in the invention without departing in any way from the spirit of the present invention.

What is desired by inventor to be protected by a Letters Patent is set forth in particular in the appended claims.

I claim:

1. A doll heart monitoring toy, comprising a doll element; a stethoscope element; electronic means producing at least one characteristic which is an immitation of a heart activity; and a magnetic member operative for turning on said electronic means when said magnetic member and at least a part of said electronic means are brought into proximity with one another, said electronic means being arranged in one of said elements, while said magnetic member is arranged in the other of said elements so that when said stethoscope element is brought into proximity to one part of said doll element said electronic means is turned on and said at least one characteristic which immitates heart activity is produced, said electronic means including a sensor arranged to sense pulse beats of a user, and a signal generator arranged to generate signals corresponding to the pulse beats sensed by said sensor.

2. A toy as defined in claim 1, wherein said stethoscope element has earphones, at least a part of said sensor being arranged in said earphones of said stethoscope element.

3. A toy as defined in claim 1, wherein said stethoscope element has earphones, said sensor being arranged at a location spaced from said earphones of said stethoscope element.

4. A toy as defined in claim 1, wherein said sensor is formed so that it senses biopotential of the user.

5. A toy as defined in claim 1, wherein said sensor of said electronic means is formed as an infrared transmission transducer.

6. A toy as defined in claim 1; and further comprising clothes on a body of said doll element, said magnetic member being arranged on the clothes.

7. A toy as defined in claim 1, wherein said signal generator is formed so that it generates audio signals corresponding to the pulse beats sensed by said sensor.

8. A toy as defined in claim 1, wherein said signal generator is formed so that it generates video signals corresponding to the pulse beats sensed by said sensor.

9. A toy as defined in claim 1, wherein said electronic means includes a further signal generator, said signal generators being formed so that one of said signal generators generates audio signals and the other of said signal generators generates video signals corresponding to the pulse beats sensed by said sensor.

10. A toy as defined in claim 1; and further comprising display means connected with said electronic means and displaying data corresponding to the pulse beats of the user, sensed by said sensor.

11. A doll heart monitoring toy, comprising a doll element; a stethoscope element; electronic means producing at least one characteristic which is an immitation of a heart activity; and a magnetic member operative for turning on said electronic means when said magnetic member and at least one part of said electronic means are brought into proximity with one another, said electronic means being arranged in one part of said doll element, while said magnetic member is arranged in said stethoscope element so that when said stethoscope element is brought into proximity to said one part of said doll element said electronic means is turned on and said at least one characteristic which immitates heart activity is produced, said electronic means including means forming an image of expanding and contracting heart in said doll element so that when said electronic means is turned on said image of expanding and contracting heart is formed in said doll element and visible to a viewer as expanding and contracting heart which is said one characteristic which said is immitation of heart activity.

12. A toy as defined in claim 11, wherein said electronic means is formed so that it also produces audio signals which substantially immitate pulse beats of a heart.

13. A toy as defined in claim 11, wherein said one part of said doll element is located in the region of an imaginary doll element heart so that turning on of said electronic means takes place when said stethoscope element is brought into proximity to said region of an imaginary doll element heart.

14. A toy as defined in claim 11, wherein said image forming means includes two heart-shaped elements formed so that one of said elements has a smaller size than the other of said elements; and further comprising means for alternatingly lighting said elements so as to form said image.

15. A toy as defined in claim 11, wherein said electronic means includes a power supply element for supplying said forming means.

16. A toy as defined in claim 15, wherein said electronic means also includes an element for producing audio signals, said power supply element also supplying said element for producing said audio signals.

17. A doll heart monitoring toy, comprising a doll element; a stethoscope element; electronic means producing at least one characteristic which is an immitation of a heart activity; and a magnetic member operative for turning on said electronic means when said magnetic member and at least one part of said electronic means are brought into proximity with one another, said electronic means being arranged in said stethoscope element, while said magnetic member is arranged in one part of said doll element so that when said stethoscope element is brought into proximity to said one part of said doll element said electronic means is turned on and said at least one characteristic which imitates heart activity is produced, said electronic means including means forming an image of expanding and contracting heart in said stethoscope element so that when said electronic means is turned on said image of expanding and contracting heart is formed in said stethoscope element and visible to a viewer as expanding and contracting heart which is said one characteristic which is said immitation of heart activity.

18. A toy as defined in claim 17, wherein said stethoscope element has earphones at its one end and a housing at its opposite end, said electronic means being accommodated in said housing.

* * * * *